United States Patent [19]

Clark

[11] Patent Number: 4,971,682

[45] Date of Patent: Nov. 20, 1990

[54] RECOVERY OF CO-ADSORBED HYDROCARBONS FROM MOLECULAR SIEVE ADSORPTION UNITS

[75] Inventor: Keith R. Clark, Houston, Tex.

[73] Assignee: UOP, Des Plaines, Ill.

[21] Appl. No.: 372,068

[22] Filed: Jun. 27, 1989

[51] Int. Cl.[5] ..... C10G 25/12

[52] U.S. Cl. ..... 208/305; 208/150; 208/245; 208/248; 208/307; 585/826; 502/515; 502/517

[58] Field of Search ..... 208/150, 307, 248, 305, 208/245; 585/826; 502/515, 517

[56] References Cited

U.S. PATENT DOCUMENTS

| | | | |
|---|---|---|---|
| 2,886,504 | 5/1959 | Christensen et al. | 585/826 |
| 3,037,338 | 6/1962 | Thomas | 585/826 |
| 3,188,293 | 6/1965 | Bacon et al. | 208/245 |
| 3,211,644 | 10/1965 | Clark | 208/307 |
| 3,654,144 | 4/1972 | Collins | 208/245 |
| 3,725,294 | 4/1973 | Turnock et al. | 502/517 |
| 4,098,677 | 7/1978 | Wayhome | 208/150 |
| 4,098,684 | 7/1978 | Innes | 208/245 |
| 4,464,250 | 8/1984 | Myers et al. | 208/150 |
| 4,795,545 | 1/1989 | Schmidt | 208/245 |

*Primary Examiner*—Helane Myers

*Attorney, Agent, or Firm*—Thomas K. McBride; Richard G. Miller

[57] ABSTRACT

In the purification of light hydrocarbons to remove carbonyl sulfide impurity by selective adsorption thereof on molecular sieve adsorbents, significant losses of the hydrocarbon are incurred by its coadsorption on the adsorbent with the COS impurity. Conventional desorption procedures produce a desorbate which is a non-commercial mixture of COS and hydrocarbon. The purge desorption method of the present invention utilizing a mixture of $CO_2$ and a non-sorbable purge gas permits recovery of the coadsorbed hydrocarbon in a pure and commercially useful form.

6 Claims, 3 Drawing Sheets

RECOVERY OF CO-ADSORBED HYDROCARBONS FROM MOLECULAR SIEVE ADSORPTION UNITS

FIELD OF THE INVENTION

The present invention relates to improved processes for the adsorption purification of hydrocarbon feedstocks and more particularly to such processes which are improved by virtue of the use of novel procedures to recover hydrocarbons co-adsorbed on the adsorbent along with the impurity constituent to be removed.

BACKGROUND OF THE INVENTION

The purification in the liquid phase of organic feedstocks such as hydrocarbons containing sulfur compound impurities by the selective adsorption of the impurity compounds on molecular sieve adsorbents is well know in the art. For example, the liquid phase purification of petroleum-derived full range hydrocarbon feedstocks containing carbonyl sulfide is disclosed in U.S. Pat. No. 3,654,144 issued to J. J. Collins, Apr. 4, 1972. Therein the process comprises passing the sour hydrocarbon feed in the liquid phase through a fixed bed of a bivalent metal cation form of zeolite A to selectively adsorb the COS. The periodic regeneration of the adsorbent bed is accomplished in the vapor phase using a non-sorbable purge gas such as nitrogen for displacement of the void space liquid as well as desorption of the COS impurity. This procedure is typical of the prior art processes insofar as regeneration is concerned. The entire volume of the gas stream used for displacement and purge desorption is isolated from the system and is largely a waste material. Equally disadvantageous economically, is the fact that the full bed void space volume of vapor phase hydrocarbon remaining in the bed along with a significant quantity of "sponged" liquid hydrocarbon and coadsorbed hydrocarbon becomes admixed with the purge gas and/or the desorbed COS impurity constituent and is either not recovered as product or must be reclaimed by a further purification procedure.

In commonly assigned U.S. application Ser. No. 155,125, filed Feb. 11, 1988 now U.S. Pat. No. 4,899,016 by K. R. Clark and P. Richman there is disclosed an improved process for the partial recovery of "sponged" liquid hydrocarbon. In accordance with this process the adsorbent bed regeneration procedure involves the use of a portion of the purified feedstock in the vapor phase to countercurrently remove the liquid held in the bed void space and a relatively non-sorbable purge gas to sequentially displace the purified feedstock vapor from the bed using plug-flow followed by a displacement of the non-sorbable purge gas from the bed void space using another portion of the purified feedstock in the vapor phase, and finally cooling and refilling the bed in a direction cocurrent with the flow of feedstock into the bed during the adsorption purification stage with a portion of the purified feedstock in the liquid phase.

A particularly difficult problem arises in processes for the purification of propane and other light hydrocarbons containing carbonyl sulfide in which liquid phase adsorption on molecular sieve adsorbents is employed to selectively adsorb the COS. It has been found that as much as 26 weight per cent of the light hydrocarbon treated is coadsorbed with the COS. Since inert gas purging of the adsorbent bed ordinarily desorbs COS and light hydrocarbon simultaneously, the desorbed hydrocarbon effluent from the bed is too highly contaminated with COS to be commercially useful.

SUMMARY OF THE INVENTION

There has now been discovered a novel process for purifying light hydrocarbon feedstocks containing from 5 to 5000 ppm (v.) COS as an impurity in which the COS is selectively adsorbed and the loss of hydrocarbon due to coadsorption is very significantly reduced compared with prior known adsorption processes. The process comprises the steps of:

(a) providing a feedstock of hydrocarbons having from 2 to 6 carbon atoms and containing from 5 to 5000 ppm (v.), preferably 10 to 1000 ppm (v.) carbonyl sulfide;

(b) passing said feedstock in the liquid phase through a fixed bed containing a molecular sieve adsorbent capable of adsorbing carbonyl sulfide and molecules of said hydrocarbon, whereby carbonyl is selectively adsorbed and a portion of said hydrocarbon is coadsorbed and a purified hydrocarbon effluent from the bed is obtained;

(c) terminating the passage of said feedstock through said bed at a time the adsorbent has remaining from 0.5 to 20 per cent of its capacity to adsorb the carbonyl suflide impurity;

(d) draining the bed of its void space held liquid;

(e) cocurrently to the direction of flow into the bed in step (a), introducing a substantially non-sorbable purge gas containing at least about 0.5 volume per cent, and preferably from about 1 to about 10 volume per cent, carbon dioxide into the bed, preferably at an elevated temperature, to desorb the coadsorbed hydrocarbon constituent of the feedstock while retaining the carbonyl sulfide impurity constituent in the adsorbed state;

(f) recovering the hydrocarbon from the effluent from the adsorption bed in step (e); and (g) regenerating the adsorption bed by desorbing the impurity constituent therefrom.

THE DRAWINGS

FIG. 1 of the drawings is a schematic flow diagram for a process embodiment of the present invention in which carbonyl sulfide is removed as an impurity constituent from a propane feedstock.

DETAILED DESCRIPTION OF THE INVENTION

Figure 1:
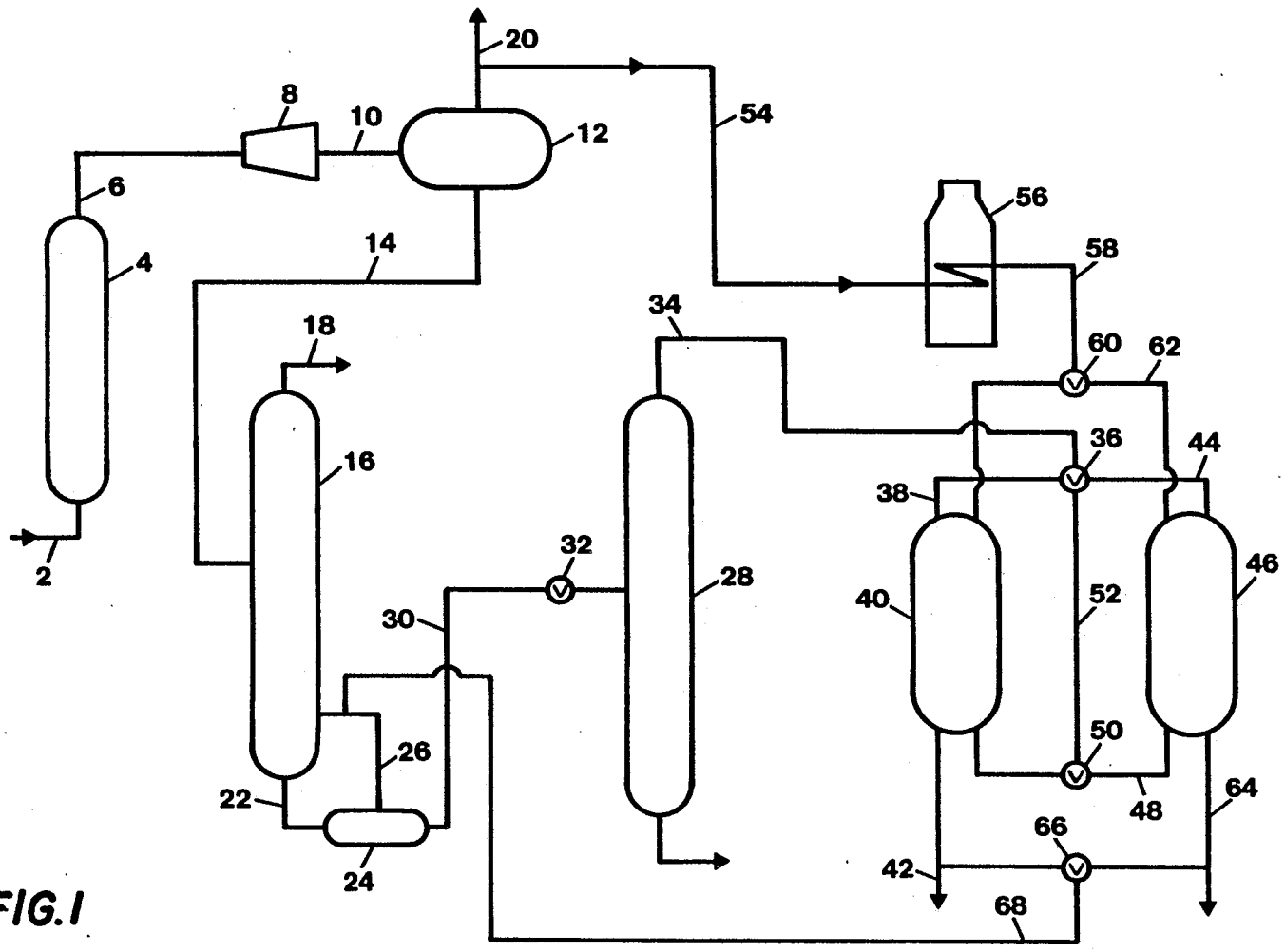

The enhanced recovery of purified hydrocarbon product which is obtained by the practice of the present process is attributable to the discovery that a non-sorbable purge gas containing a relatively small concentration of carbon dioxide is capable of selectively desorbing the hydrocarbon from a molecular sieve adsorbent which contains sponged hydrocarbon and hydrocarbon coadsorbed with carbonyl sulfide.

The molecular sieve adsorbent used in the process is not a narrowly critical aspect of the invention and is selected with regard to the molecular dimensions, polarity, volatility and the like of the COS and any other impurity constituent to be removed, such as $H_2S$ and $H_2O$. Zeolitic molecular sieves such as 13X, 4A and 5A widely used for adsorption-purification processes are preferred adsorbents, with zeolite 5A being a particularly preferred adsorbent. Non-zeolitic adsorbents such as the $AlPO_4$'s, SAPO's and MeAPO's more recently discovered and made available commercially are also suitably employed. Such materials are described in detail in the patent literature, for instance, U.S. Pat. Nos. 4,567,029, 4,310,440 and U.S. Pat. No. 4,440,871.

The light hydrocarbon feedstock composition is also not narrowly critical. It is preferred, however that the major proportion of the feedstock is an olefin or diolefin containing from 3 to 6 carbon atoms, or a paraffin containing from 2 to 4 carbon atoms. In general hydrocarbons containing from 2 to 6 carbon atoms are suitable for treatment by the present process. Propane is a particularly preferred hydrocarbon, either alone or in admixture with another light hydrocarbon or with a molecular species not significantly adsorbed by the adsorbent employed by reason of molecular size or degree of polarity, such as highly branched chain hydrocarbons, aromatics and the like. In general the COS concentration of the feedstock is from about 5 to 2000 ppm (v.) and is preferably from about 50 to 500 ppm (v.). Other impurity constituents which are more strongly sorbed on the molecular sieve adsorbent employed, such as mercaptans and $H_2S$, can also be present in the feedstock.

The non-sorbable purge gas stream containing $CO_2$ used to recover the sponged and coadsorbed propane from the adsorbent can be any of the inert gases, hydrogen, nitrogen and methane or mixtures thereof. The $CO_2$ content should be at least 0.5 vol.-% and is preferably within the range of about 1 to about 5 vol.-%

The temperature and pressure conditions, flow rates, adsorption bed sizes and configurations will vary depending upon the feedstock being treated but their selection is well within the routine skill of the art in view of the present specification.

ILLUSTRATIVE EMBODIMENT

Figure 2:
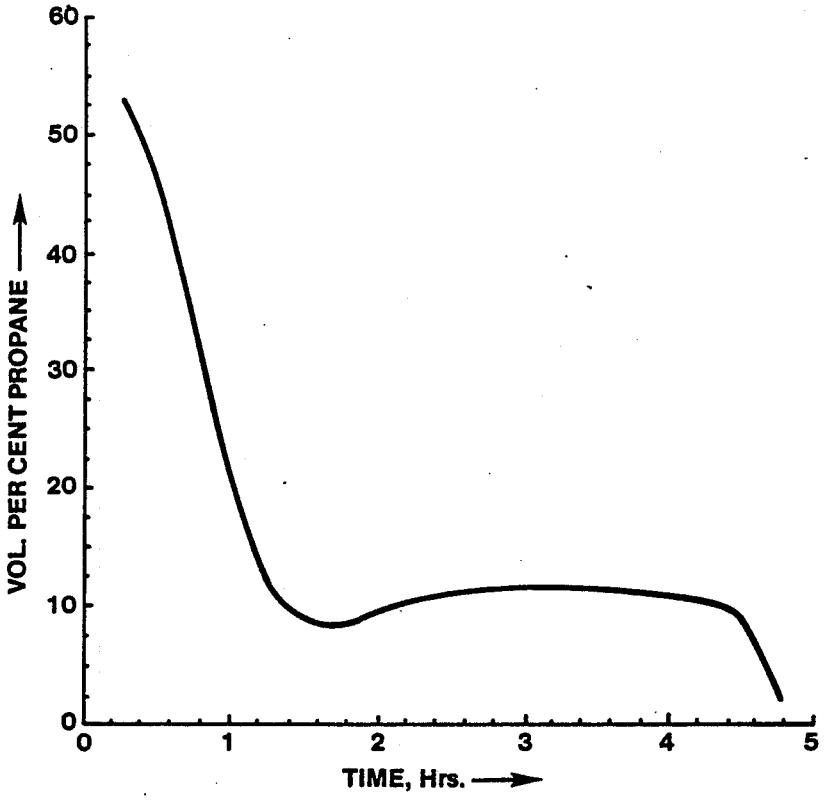
FIG. 2 is a plot of data showing the propane content of adsorption bed effluent as a function of the time of $CO_2$- containing purge gas flow into the bed during the process step of purge recovery of propane.

The various embodiments of the present invention are illustrated by the following specific process system which concerns the removal of carbonyl sulfide from propane. The source of the propane is a sour natural gas stream which has been initially treated in an adsorption bed to remove most of the water and $H_2S$ present, which has been further treated in a deethanizer to remove the ethane, and is the overhead effluent from a depropanizer. As such the feedstock typically contains propane, ethane, butanes, hydrogen sulfide and carbonyl sulfide:

With reference to FIG. 1 of the drawings, a sour natural gas stream at a pressure of 5155 kg/m$^2$ (gauge) is passed to an adsorption unit 4 through line 2 and a sweetened product effluent comprised of methane, ethane, propane, $CO_2$ and COS is removed from the bed through line 6 and then fed through expander 8 and line 10 to (separator) 12 at a pressure of 1524 kg/m$^2$ (gauge). The COS and the $C^+_2$ hydrocarbons in the liquid state in separator 12 are passed to deethanizer column 16 through line 14. The residual (overhead) gas from separator 12 consists essentially of methane, but also contains about 3.4 per cent (vol.) carbon dioxide and 1.5 ppm (v.) COS. A portion of this gas stream is utilized to regenerate adsorption bed 16 and the remainder is employed to regenerate the propane purification beds as described hereinafter. Product methane containing $C_2$ hydrocarbon is removed from the system through line 20. The bottoms from deethanizer 16 are partially recycled through line 22, reboiler 24 and line 26, and the remainder is passed to depropanizer column 28 through line 30 and valve 32. The overhead from column 28 comprises propane and about 320 ppm (v) COS impurity. Carbon dioxide, if present, is below the detectability level of 25 ppm (v.) using gas chromatographic analysis. This gas stream is passed at a temperature of about 22° C. through line 34, valve 36 and line 38 into the top of adsorbent bed 40 containing about 41,000 kilograms of zeolite 5A molecular sieve adsorbent agglomerates. Bed 40 has, at the beginning of the adsorption purification step, been regenerated, cooled to 32° C. and filled with feedstock. The flow rate of feedstock into bed 40 is from about 25,436 to 30,000 kilograms per hour. Purified propane is recovered through line 42, while COS is retained in bed 40 as an adsorbate. The bed capacity is such that the adsorption-purification step proceeds for 8.0 hours, after which time feedstock flow is diverted via valve 36 through line 44 and into adsorbent bed 46. During the 8 hour period, bed 40 is engaged in adsorption-purification, adsorbent bed 46 is undergoing regeneration following a similar adsorption-purification step therein. As the first stage of bed regeneration, the void space liquid is drained through line 48, valve 50, line 52 and valve 36 and passed as a portion of the feedstock to bed 40 through line 38. Draining and displacement of the liquid from bed 46 can be aided by the introduction of residue gas flowing from separator 12 through line 20, line 54 furnace 56, line 58, valve 60 and line 62. Following completion of the liquid drainage step the temperature of the residue gas stream is increased to 288° C. and is maintained at that temperature for about 4.5 hours at a flow rate of 113,275 standard cubic meters per day in order to purge from the bed the void space propane vapor and the propane coadsorbed with the COS impurity on the molecular sieve adsorbent. The propane-containing effluent from bed 46 during this purging step is recycled to deethanizer column 16 via line 64, valve 66, line 68 and line 26, passed to depropanizer column 28 along with the bottoms from deethanizer column 16, as described hereinabove, and thereafter to adsorption bed 40, from which purified propane is recovered and removed from the system. The duration of the purge step in which sponged and coadsorbed propane is recovered is readily determined by monitoring the concentration of propane in the bed effluent. With reference to FIG. 2, it is observed in the process embodiment described herein that in the first few minutes after purging with residue gas at 288° C. begins, the propane content of the bed effluent is about 53 volume -%. At the end of the first 1.5 hours of this purging, the propane content of the bed effluent has decreased to about 7.5 volume -%. It is believed that this propane effluent is primarily sponged (void space) propane. Over the next 3 hour period of continued purging the propane content of the bed effluent remains relatively unchanged, after an initial slight rise from 7.5 volume -%, at about 11 volume -%. During this period the propane is believed to be produced in the bed by displacement of coadsorbed propane from the molecular sieve by virtue of purging action of the non-sorbable constituents of the residue gas and the displacement action the carbon dioxide constituent of the residue gas. After 4.5 hours elapsed purge time, the propane concentration of the bed effluent declines rapidly, indicating that the desorption of coadsorbed propane is nearly complete.

Figure 3:
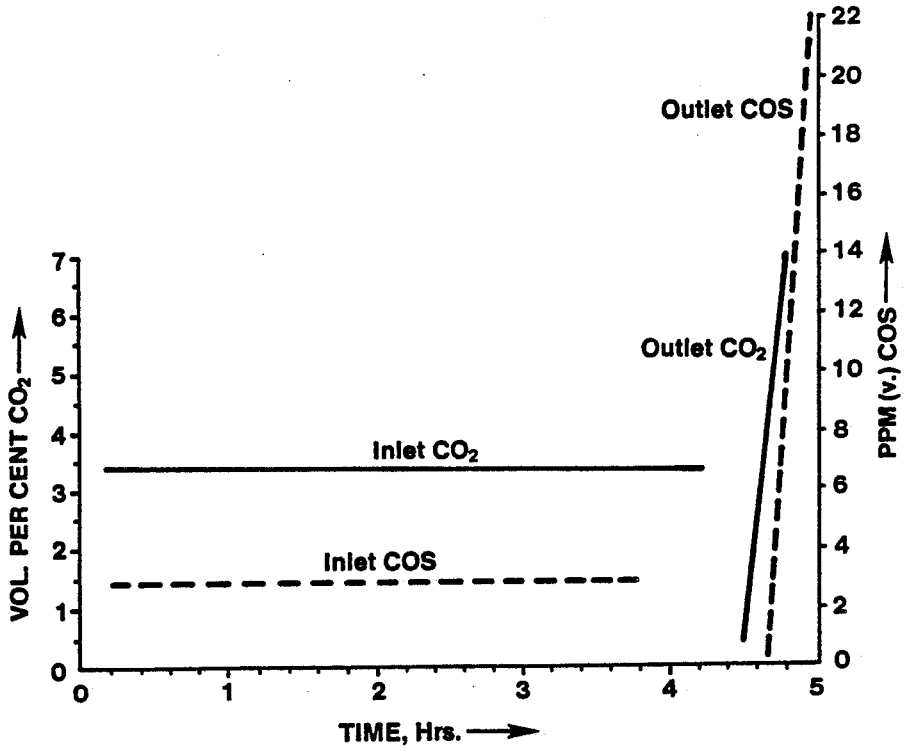
FIG. 3 is a plot of data showing the $CO_2$ and COS content of adsorption bed effluent as a function of the time of $CO_2$ and COS containing purge gas flow into the bed during the process step of purge recovery of propane.

These beliefs are clearly supported by the data of FIG. 3 taken over the same time period as those in FIG. 2 by monitoring both the influent and effluent streams from the same adsorption bed. The $CO_2$ concentration of the stream entering the bed is essentially constant at about 3.4 volume -% as is the inlet COS concentration at about 3 ppm (v.). Until after about 4.5 hours of purging the concentration of both $CO_2$ and COS in the bed effluent are much smaller than the inlet concentrations, indicating adsorption of both of those substances on the bed adsorbent. Upon near completion of the displacement of propane from the adsorbent by the $CO_2$ and an exhaustion of the bed capacity for COS, the concentration of both $CO_2$ and COS begin to increase very rapidly in the bed effluent, signaling the time for termination of recycle purge recovery of propane and the time for beginning the bed regeneration to remove adsorbed COS impurity from the bed and from the system. In the case of bed 46 in FIG. 1, COS is removed from the system through line 64.

While the invention has been illustrated and described in terms of enhanced propane recovery in its purification with respect to COS, it will be understood that the principles involved can be applied to other purification processes in which the hydrocarbon to be recovered is an olefin, diolefin or paraffin having from 2 to 6 carbon atoms, for example ethane, butane, propylene and butylene.

What is claimed is:

1. Process for removing carbonyl sulfide from a hydrocarbon feedstock which comprises:

(a) providing a feedstock of hydrocarbons having from 2 to 6 carbon atoms and containing from 5 to 5000 ppm (v.) carbonyl sulfide;

(b) passing said feedstock in the liquid phase through a fixed bed containing a molecular sieve adsorbent capable of adsorbing carbonyl sulfide and molecules of said hydrocarbon, whereby carbonyl is selectively adsorbed and a portion of said hydrocarbon is coadsorbed and a purified hydrocarbon effluent from the bed is obtained;

(c) terminating the passage of said feedstock through said bed at a time the adsorbent has remaining from 0.5 to 20 percent of its capacity to adsorb the carbonyl sulfide impurity;

(d) draining the b ed of its void space held liquid;

(e) cocurrently to the direction of flow into the bed in step (a), introducing a substantially non-sorbable purge gas containing from about 1 to about 10 volume percent carbon dioxide into the bed to desorb the coadsorbed hydrocarbon constituent of the feedstock while retaining the carbonyl sulfide impurity constituent in the adsorbed state;

(f) recovering the hydrocarbon from the effluent from the adsorption bed in step (e); and (g) regenerating the adsorption bed by desorbing the impurity constituent therefrom.

2. Process according to claim 1 wherein the hydrocarbon is an olefin or diolefin containing from 3 to 6 carbon atoms.

3. Process according to claim 1 wherein the hydrocarbon is a paraffin containing from 2 to 4 carbon atoms.

4. Process according to claim 3 wherein the hydrocarbon is propane.

5. Process according to claim 4 wherein the feedstock contains from 50 to 500 ppm (v.) carbonyl sulfide.

6. Process according to claim 1 wherein the hydrocarbon is propane and the non-sorbable purge gas employed in step (e) contains from 1 to 5 volume per cent carbon dioxide.

* * * * *